US007506646B2

(12) United States Patent
Park

(10) Patent No.: US 7,506,646 B2
(45) Date of Patent: Mar. 24, 2009

(54) SILENCER FOR AIRLINE-HOOD AND PROTECTIVE HOOD HAVING THE SAME

(76) Inventor: Chun Bae Park, 4B20L, 1063-19, Eobang-dong, Gimhae Si, Gyeongsangnam-Do (KR)

( * ) Notice: Subject to any disclaimer, the term of this patent is extended or adjusted under 35 U.S.C. 154(b) by 0 days.

(21) Appl. No.: 11/652,731

(22) Filed: Jan. 12, 2007

(65) Prior Publication Data

US 2007/0125237 A1 Jun. 7, 2007

Related U.S. Application Data

(63) Continuation of application No. PCT/KR2005/002240, filed on Jul. 12, 2005.

(30) Foreign Application Priority Data

Jul. 14, 2004 (KR) ..... 10-2004-0054684
Jul. 14, 2004 (KR) ..... 20-2004-0020043 U
Jul. 7, 2005 (KR) ..... 20-2005-0019771 U

(51) Int. Cl.
*A62B 17/04* (2006.01)

(52) U.S. Cl. ..... 128/201.23; 128/201.25; 128/201.29; 128/202.19; 2/262; 2/906

(58) Field of Classification Search ..... 128/201.22–201.29, 202.11, 202.19; 2/262, 2/906

See application file for complete search history.

(56) References Cited

U.S. PATENT DOCUMENTS

| | | | | |
|---|---|---|---|---|
| 3,181,532 | A * | 5/1965 | Harris | 128/201.23 |
| 4,207,883 | A * | 6/1980 | Shindler | 128/201.22 |
| 4,455,687 | A * | 6/1984 | Johansson | 2/424 |
| 4,466,432 | A * | 8/1984 | Wise | 128/201.23 |
| 4,848,330 | A | 7/1989 | Cowles | |
| 5,526,805 | A | 6/1996 | Lutz et al. | |

FOREIGN PATENT DOCUMENTS

| | | | |
|---|---|---|---|
| JP | 60-43231 | U | 3/1985 |
| JP | 2003-000739 | A | 1/2003 |
| KR | 20-1999-0015670 | U | 5/1999 |
| KR | 20-0358434 | Y1 | 8/2004 |

* cited by examiner

*Primary Examiner*—Steven O Douglas
(74) *Attorney, Agent, or Firm*—Park & Associates IP Law LLC

(57) ABSTRACT

Disclosed herein are a silencer for an airline hood and a protective hood having the silencer. The present invention reduces the speed of air fed into a space between upper and lower units, using an air distributing means, prior to discharging the air through air outlet holes formed on the lower unit to the outside of the space, thus minimizing noise due to the air. Further, the silencer for an airline hood is installed in the protective hood, thus minimizing noise, therefore increasing work efficiency, when a worker works with the protective hood on.

15 Claims, 6 Drawing Sheets

SILENCER FOR AIRLINE-HOOD AND PROTECTIVE HOOD HAVING THE SAME

REFERENCE TO RELATED APPLICATIONS

This a continuation of pending International Patent Application PCT/KR2005/002240 filed on Jul. 12, 2005, which designates the United States and claims priority of Korean Patent Application No. 20-2004-0020043 filed on Jul. 14 2004; No. 10-2004-0054684 filed on Jul. 14, 2004; No. 20-2005-0019771 filed on Jul. 7, 2005.

FIELD OF THE INVENTION

The present invention relates, in general, to a silencer for an airline hood and a protective hood having the silencer and, more particularly, to a silencer for an airline hood, which is installed at an air inlet side of the airline hood, thus reducing noise generated by air fed into the airline hood through an air inlet, and to a protective hood having the silencer.

BACKGROUND OF THE INVENTION

Generally, an airline hood is a hood which is equipped with an airline so as to supply fresh air from an outside into the hood. A protective hood, which is worn by a worker so as to protect the worker during sanding, shortening, and painting works, is a kind of airline hood. When the worker wears the protective hood, fresh air is continuously fed into the protective hood through the airline, thus allowing the worker to breathe easily.

Particularly, when a worker works in a sealed space, the worker must inevitably wear protective clothes and the protective hood. In order to supply fresh air to the worker, an airline is provided on the protective hood.

The fresh air is forcibly injected into the protective hood through the airline coupled to the interior of the protective hood, using a compressor.

However, the protective hood is configured to be sealed, so that loud noise may be generated in the protective hood due to pressure of air fed into the protective hood. Thereby, a worker has a difficulty in working, and in addition, work efficiency is reduced.

SUMMARY OF THE INVENTION

Accordingly, the present invention has been made keeping in mind the above problems occurring in the prior art, and an object of the present invention is to provide a silencer for an airline hood, which is installed at an end of an airline coupled to the interior of the airline hood, thus reducing noise generated by air fed into the airline, and a protective hood having the silencer for the airline hood.

In order to accomplish the object, the present invention provides a silencer for an airline hood, including an upper unit open at a lower portion thereof and formed to be upwardly convex, with an air inlet port being provided at a predetermined position on the upper unit and being coupled to an airline; a lower unit hermetically coupled to the lower portion of the upper unit, thus defining a space, with a plurality of air outlet holes being vertically formed through the lower unit; and an air distributing means provided on the lower portion of the upper unit and an upper portion of the lower unit, and distributing air fed from the airline in the space prior to discharging the air through the air outlet holes.

Preferably, the upper unit has a circular shape.

Further, the lower unit is coupled to an outer end of the upper unit, the air outlet holes being formed on the lower unit in such a way as to be continued along a curved surface of the upper unit from an inner end of the upper unit to the outer end thereof.

The air outlet holes are formed along a circumference of the lower unit, and are formed on an outer portion of the lower unit at angular intervals from 30 degrees to 45 degrees.

Further, the air distributing means includes a first distributing ring provided on the lower unit, and formed to be concentric with the air inlet port, the first distributing ring primarily colliding with the air fed from the airline, thus reducing a flow rate of the air; a second distributing ring provided on the upper unit, and formed to be concentric with the first distributing ring, the second distributing ring colliding with the air which has collided with the first distributing ring and has the reduced flow rate, thus secondarily reducing the flow rate of the air; and a third distributing ring provided on the lower unit, and formed to be concentric with the second distributing ring, the third distributing ring colliding with the air which has been reduced in flow rate by the second distributing ring, thus further reducing the flow rate of the air.

The air distributing means further includes soundproof sponge provided inside the first distributing ring, between the first and second distributing rings, between the second and third distributing rings, and outside the third distributing ring.

In order to accomplish the object, the present invention provides a protective hood coupled to an airline to supply air into a protective cap, including a silencer which is installed in the protective cap to reduce noise caused by air from the airline and includes an upper unit open at a lower portion thereof and formed to be upwardly convex, with an air inlet port being provided at a predetermined position on the upper unit and being coupled to the airline; a lower unit hermetically coupled to the lower portion of the upper unit, thus defining a space, with a plurality of air outlet holes being vertically formed through the lower unit; and an air distributing means provided on the lower portion of the upper unit and an upper portion of the lower unit, and distributing air fed from the airline in the space prior to discharging the air through the air outlet holes.

Preferably, the upper unit has a circular shape.

The lower unit is coupled to an outer end of the upper unit, the air outlet holes being formed on the lower unit in such a way as to be continued along a curved surface of the upper unit from an inner end of the upper unit to the outer end thereof.

Further, the air outlet holes are formed along a circumference of the lower unit, and are formed on an outer portion of the lower unit at angular intervals from 30 degrees to 45 degrees.

The air distributing means includes a first distributing ring provided on the lower unit, and formed to be concentric with the air inlet port, the first distributing ring primarily colliding with the air fed from the airline, thus reducing a flow rate of the air; a second distributing ring provided on the upper unit, and formed to be concentric with the first distributing ring, the second distributing ring colliding with the air which has collided with the first distributing ring and has the reduced flow rate, thus secondarily reducing the flow rate of the air; and a third distributing ring provided on the lower unit, and formed to be concentric with the second distributing ring, the third distributing ring colliding with the air which has been reduced in flow rate by the second distributing ring, thus further reducing the flow rate of the air.

The air distributing means further includes soundproof sponge provided inside the first distributing ring, between the first and second distributing rings, between the second and third distributing rings, and outside the third distributing ring.

In order to accomplish the object, the present invention provides a protective hood configured such that an airline is coupled to an outer portion of a protective cap having an air inlet port so as to supply air into the protective cap, including: a silencer installed in the protective cap, the silencer having a shape corresponding to a shape of the protective cap, and being attached to the protective cap such that the air inlet port of the protective cap is positioned at a center of the silencer, thus defining a predetermined space between the silencer and an inner surface of the protective cap, with a plurality of air outlet holes being formed vertically through a lower portion of the silencer to communicate with the space.

Preferably, the air outlet holes are formed on an outer portion of the silencer at angular intervals from 30 degrees to 45 degrees.

The protective hood further includes soundproof sponge provided in the space.

As described above, the present invention reduces the speed of air fed into a space between upper and lower units, using an air distributing means, prior to discharging the air through air outlet holes formed on the lower unit to the outside of the space, thus minimizing noise due to the air.

Further, a silencer for an airline hood is installed in a protective hood, so that air fed into the protective hood collides with an inner wall of the space and thereby is reduced in its speed, prior to discharging the air through the air outlet holes to the outside of the space, thus minimizing noise due to the air, therefore allowing a worker to efficiently work while the worker having the protective hood on.

DETAILED DESCRIPTION OF THE INVENTION

Hereinafter, the preferred embodiments of this invention will be described in detail with reference to the accompanying drawings.

First Embodiment

Figure 1:
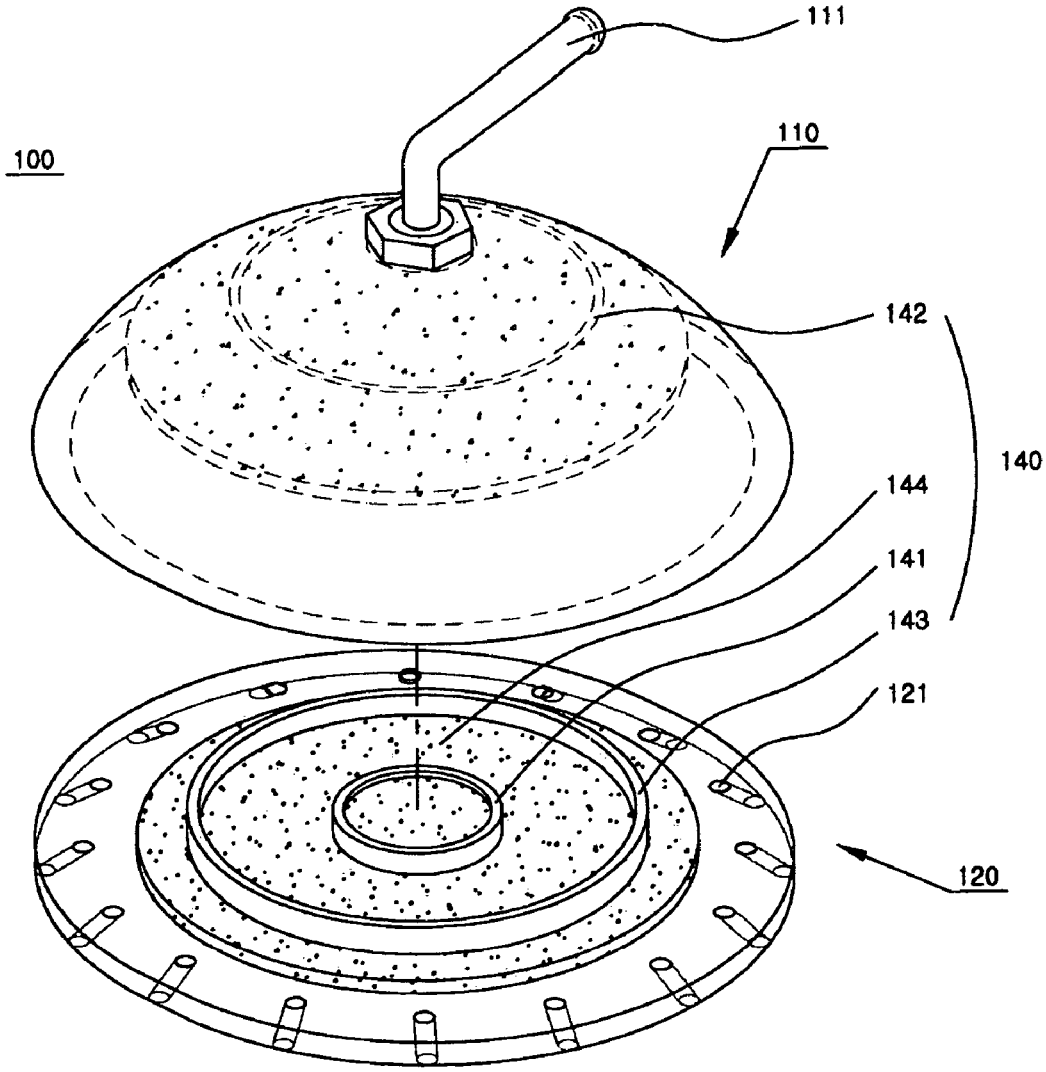
FIG. 1 is a perspective view of a silencer for an airline hood, according to the first embodiment of the present invention.
Figure 2:
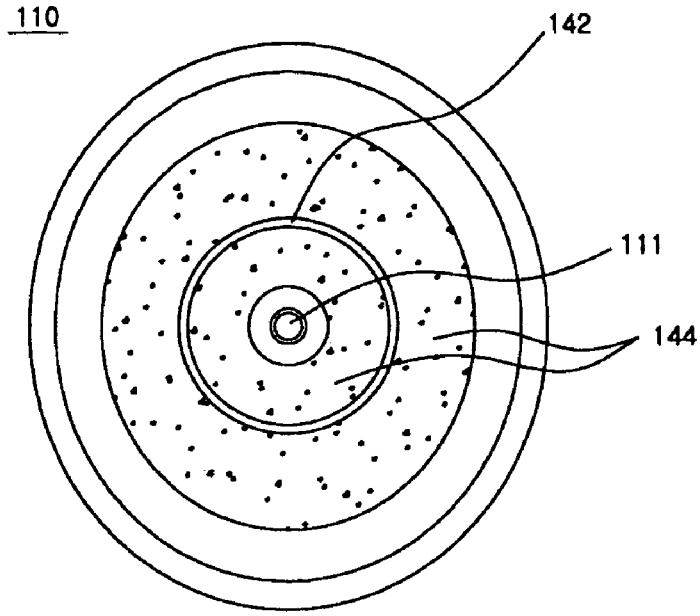
FIG. 2 is a front view of an upper unit of the silencer for the airline hood, according to the first embodiment of this invention.
Figure 3:
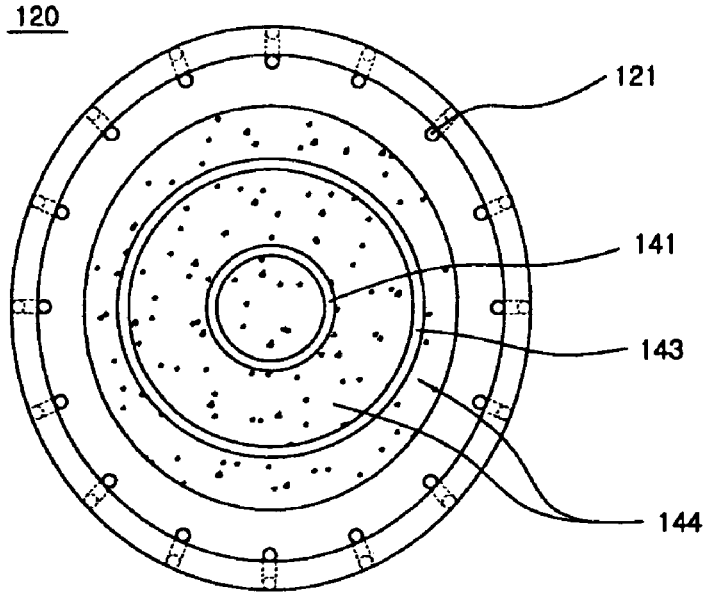
FIG. 3 is a front view of a lower unit of the silencer for the airline hood, according to the first embodiment of this invention.
Figure 4:
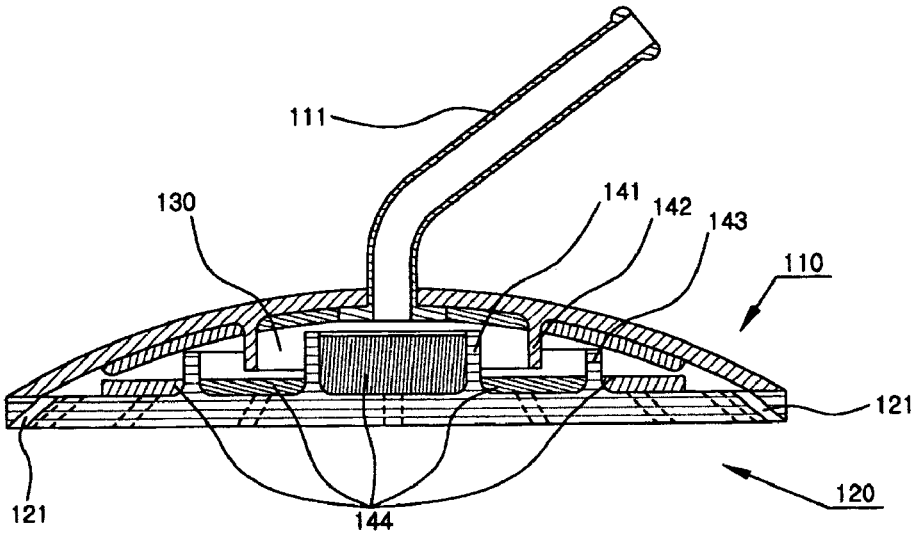
FIG. 4 is a vertical sectional view of the silencer for the airline hood, according to the first embodiment of this invention.
Figure 5:
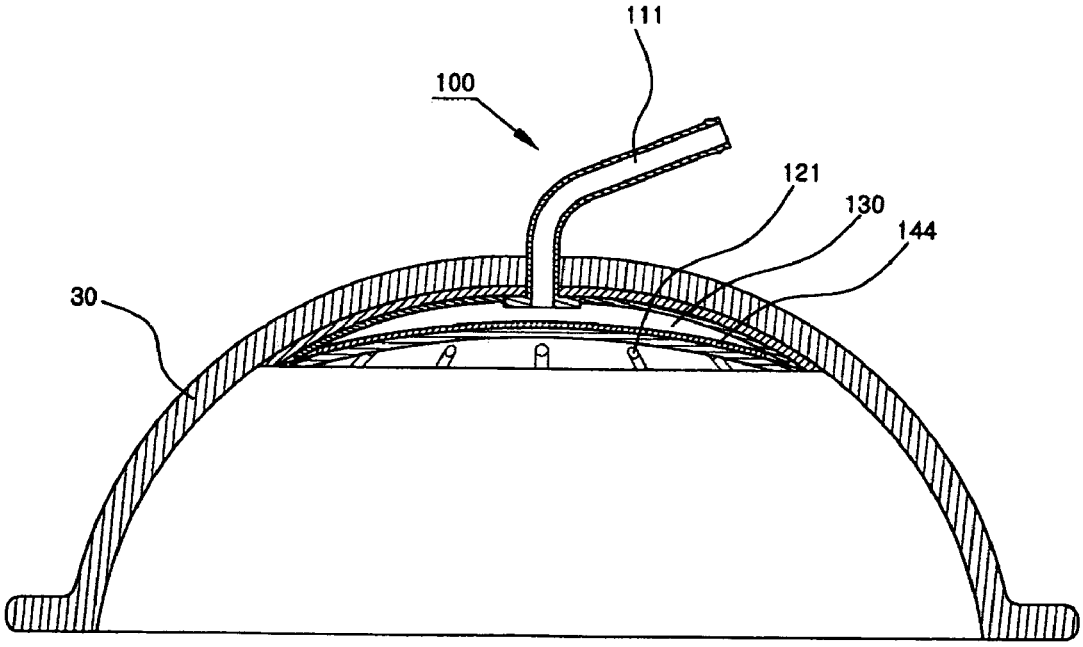
FIG. 5 is a vertical sectional view of a protective hood equipped with the silencer for the airline hood, according to the first embodiment of this invention.
Figure 6:
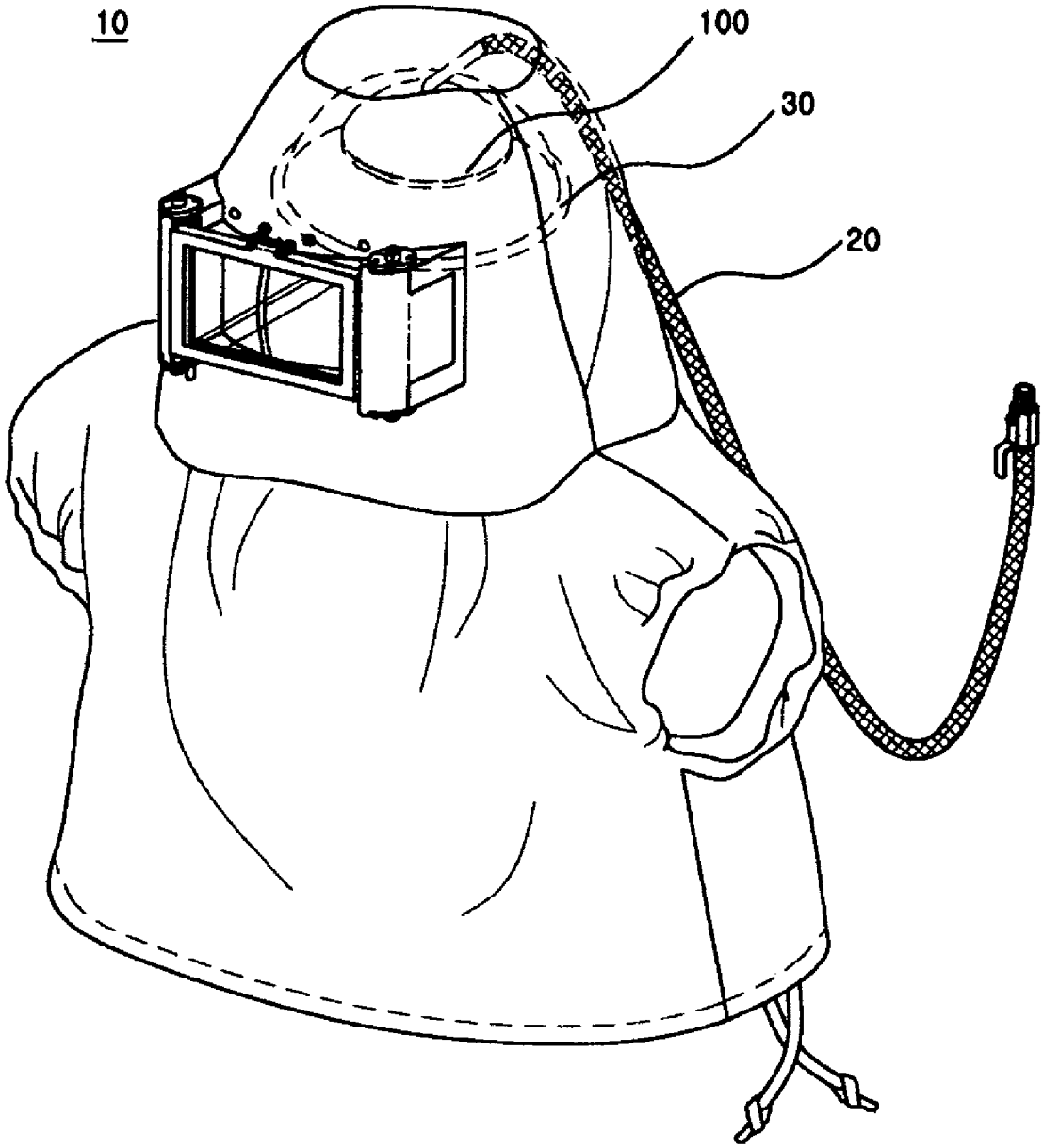
FIG. 6 is a view to show the use of the protective hood having the silencer for the airline hood, according to the first embodiment of this invention.

FIG. 1 is a perspective view of a silencer for an airline hood, according to the first embodiment of the present invention, FIG. 2 is a front view of an upper unit of the silencer for the airline hood, according to the first embodiment of this invention, FIG. 3 is a front view of a lower unit of the silencer for the airline hood, according to the first embodiment of this invention, FIG. 4 is a vertical sectional view of the silencer for the airline hood, according to the first embodiment of this invention, FIG. 5 is a vertical sectional view of a protective hood equipped with the silencer for the airline hood, according to the first embodiment of this invention, and FIG. 6 is a view to show the use of the protective hood having the silencer for the airline hood, according to the first embodiment of this invention.

As shown in the drawings, a silencer 100 for an airline hood of this invention includes an upper unit 110, a lower unit 120, a space 130 defined between the upper and lower units 110 and 120, and an air distributing means 140.

First, the upper unit 110 will be described below in detail.

The upper unit 110 is open at a lower portion thereof, and is formed to be upwardly convex. An air inlet port 111 is provided at a predetermined position on the upper unit 110, and is coupled to an airline 20. Preferably, the upper unit 110 is formed to be upwardly convex and have a circular cross-section.

That is, the upper unit has a spherical shape to be easily inserted into a protective hood 10. When air is fed from the airline 20 through the air inlet port 111 into the upper unit 110, the air collides with the curved upper unit 110, thus allowing the air to smoothly flow, and minimizing noise due to friction between the air and the upper unit.

The lower unit 120 will be described below in detail.

The lower unit 120 is hermetically coupled to the lower portion of the upper unit 110, thus defining the space 130. A plurality of air outlet holes 121 is formed through upper and lower portions of the lower unit 120.

The upper and lower units 110 and 120 are hermetically coupled to each other. In this case, the upper unit 110 is formed to be upwardly convex, and the lower unit 120 is formed to be flat or slightly upwardly convex. Due to such a construction, the space 130 is naturally defined between the upper and lower units 110 and 120.

Air is fed from the airline 20 through the air inlet port 111 to the space 130. Further, the air is discharged through the air outlet holes 121. Thereby, the air is supplied to a worker who wears the protective hood 10.

Further, the lower unit 120 is mounted to the outer end of the upper unit 110. Preferably, the air outlet holes 121 are formed on the outer portion of the lower unit 120 in such a way as to be continued along the curved surface of the upper unit 110 from the inner end of the upper unit 110 to the outer end thereof. In this case, the air outlet holes 121 are formed along the circumference of the lower unit 120 at regular intervals. Preferably, the air outlet holes 121 are formed on the outer circumference of the lower unit 120 at angular intervals from 30 degrees to 45 degrees.

Due to such an arrangement, air fed into the space 130 collides with inner walls of the upper and lower units 110 and 120, so that the flow rate is reduced, and thereby the air is evenly discharged through the air outlet holes 121 arranged along the curved surface of the upper unit 110. Thus, a worker can smoothly respire fresh air with little noise.

The air distributing means 140 will be described below.

The air distributing means 140 is configured to protrude downwards from the upper unit 110 and protrude upwards from the lower unit 120. The air distributing means 140 distributes air, fed from the airline 20, in the space 130 which is hermetically formed within the upper and lower units 110 and 120, prior to discharging the air through the air-outlet holes 121.

The air distributing means 140 is provided to protrude downwards from the upper unit 110 and upwards from the lower unit 120. Thereby, air fed through the air inlet port 111 collides with and flows along the air distributing means 140. Afterwards, the air flows to the outer portion of the space 130 and is discharged through the air outlet holes 121.

In this case, the air distributing means 140 protrudes from the lower portion of the upper unit 110 and the upper portion of the lower unit 120. The air distributing means 140 includes a first distributing ring 141, a second distributing ring 120, and a third distributing ring 143, which are alternately arranged.

The first distributing ring 141 is provided on the lower unit 120, and is concentric with the air inlet port 111. Air fed from the airline 20 primarily collides with the first distributing ring 141, thus reducing the flow rate.

The second distributing ring 142 is provided on the upper unit 110, and is concentric with the first distributing ring 141. The air, which has collided with the first distributing ring 141 and is reduced in flow rate, secondarily collides with the second distributing ring 142. Thereby, the flow rate of the air is further reduced.

The third distributing ring 143 is provided on the lower unit 120, and is concentric with the second distributing ring 142. The air, which has collided with the second distributing ring 142 and is reduced in flow rate, collides with the third distributing ring 143. Thereby, the flow rate of the air is further reduced.

That is, high-speed air is fed through the air inlet port 111 into the space 130, and subsequently collides with the first distributing ring 141. The flow rate of air primarily colliding with the ring 141 is primarily reduced. The air passes over the first distributing ring 141, and moves to the outer portion of the space 130.

Subsequently, the air passing over the first distributing ring 141 enters a part of the space 130 defined outside the first distributing ring 141 prior to colliding with the second distributing ring 142. The flow rate of the air is secondarily reduced. The air passes over the second distributing ring 142, and moves to the outer portion of the space 130.

Next, the air passing over the second distributing ring 142 collides with a part of the space 130 defined outside the second distributing ring 142 prior to colliding with the third distributing ring 143. The flow rate of the air is further reduced. The air passes over the third distributing ring 143, and moves to the outer portion of the space 130. Finally, the air is discharged through the air outlet holes 121.

Further, as necessary, the number of air distributing means 140 may be variously changed according to the size of the upper unit 110 or the lower unit 120.

Preferably, the air distributing means 140 further includes soundproof sponge 144 inside the first distributing ring 141, between the first distributing ring 141 and the second distributing ring 142, between the second distributing ring 142 and the third distributing ring 143, and outside the third distributing ring 143.

The soundproof sponge 144 has the shape of a disc, thus further reducing the flow rate of air entering the space 130, and reducing noise generated by the flow of air.

Figure 7:
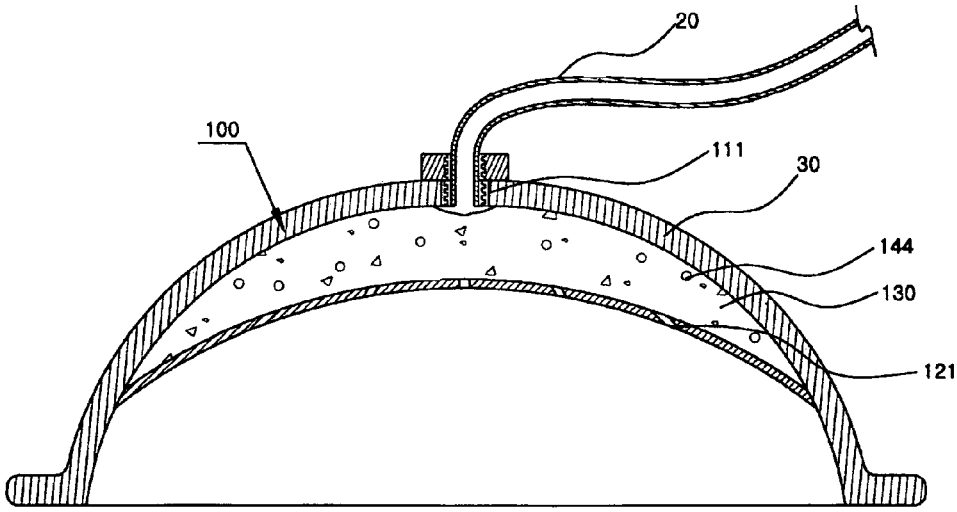
FIG. 7 is a vertical sectional view of a protective hood having a silencer for an airline hood, according to the second embodiment of this invention.

The silencer 100 for the airline hood constructed as described above is installed in the protective hood 10 which is coupled to the airline 20 so as to feed air into a protective cap 30, as shown in FIGS. 6 and 7.

That is, an end of the airline 20 is coupled to the air inlet port 111, prior to installing the silencer 100 into the protective cap 30. A user wears the protective hood equipped with the silencer 100 for the airline hood, thus easily respiring fresh air under low-noise conditions while working.

The operational effects of this invention constructed as described above will be described below.

First, the air inlet port 111 provided on the upper unit 110 is coupled to an end of the airline 20 protruding inside the protective hood 10. Next, a compressor coupled to the exterior airline 20 is operated. At this time, air flows along the airline 20, and is fed into the air inlet port 111.

The air fed into the air inlet port 111 moves into the space 130 and collides with the internal parts of the space 130, so that the flow rate of the air is reduced. That is, the high-speed air fed through the air inlet port 111 collides with the space 130. At this time, the soundproof sponge 144 provided in the space 130 reduces noise.

Subsequently, the air collides with the first distributing ring 141, and the flow rate of the air is primarily reduced. The air passes over the first distributing ring 141 and moves to the outer portion of the space 130. The air passing over the first distributing ring 141 enters the space 130 defined outside the first distributing ring 141, prior to colliding with the second distributing ring 142. The flow rate of the air colliding with the second distributing ring 142 is secondarily reduced. Thereafter, the air passes over the second distributing ring 142 and moves to the outer portion of the space 130.

Afterwards, the air enters the space 130 defined outside the second distributing ring 142, prior to colliding with the third distributing ring 143. The flow rate of the air is further reduced. The air passes over the third distributing ring 143, and moves to the outer portion of the space 130. Finally, the air is discharged through the air outlet holes 121.

At this time, the soundproof sponge 144 provided between the distributing rings serves to reduce the flow rate of air which enters the space 130 defined between the upper and lower units 110 and 120. That is, the soundproof sponge absorbs noise generated due to the collision of air, thus further reducing the noise.

Second Embodiment

Figure 8:
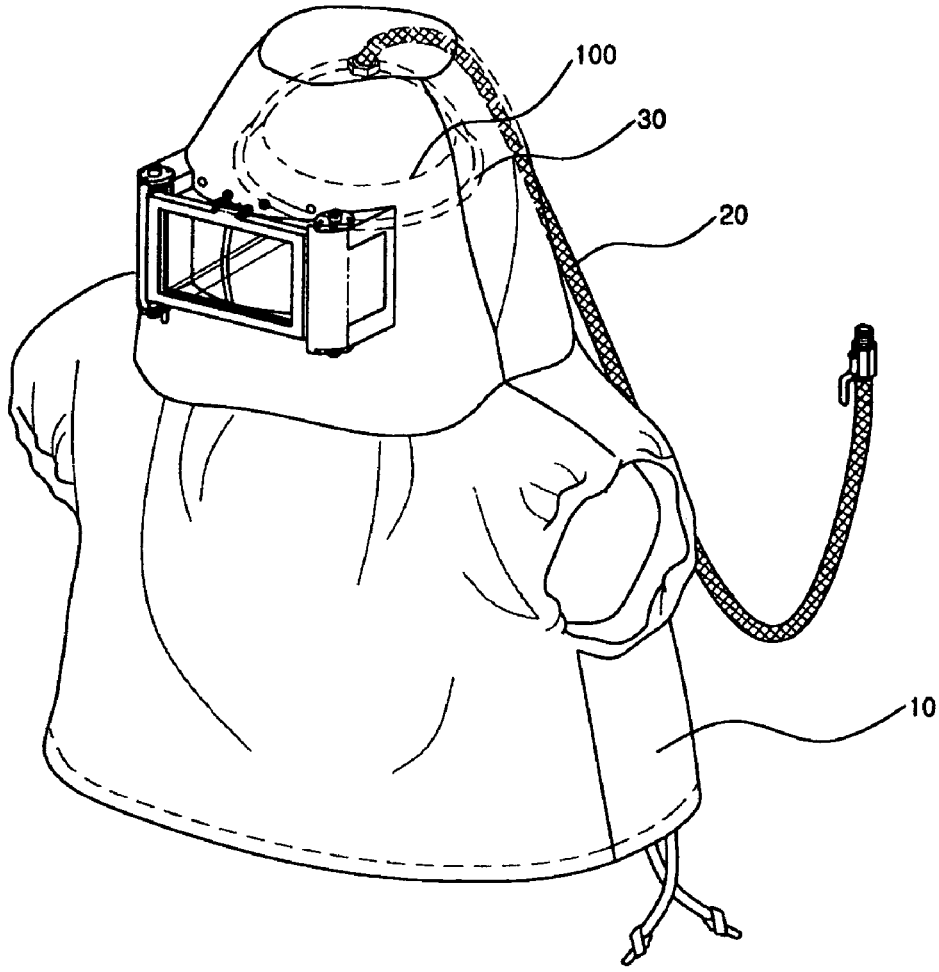
FIG. 8 is a view to show the use of the protective hood having the silencer for the airline hood, according to the second embodiment of this invention.

FIG. 7 is a vertical sectional view of a protective hood having a silencer for an airline hood, according to the second embodiment of this invention, and FIG. 8 is a view to show the use of the protective hood having the silencer for the airline hood, according to the second embodiment of this invention.

As shown in the drawings, a silencer 100 for an airline hood according to this invention is installed in a protective hood 10. The protective hood 10 is configured such that an airline 20 is coupled to an outer portion of a protective cap 30 having an air inlet port 111 and supplies air into the protective cap 30.

The silencer 100 has an upwardly convex shape to correspond to the shape of the protective cap 30. The silencer 100 is attached to the inner surface of the protective cap 30 using an adhesive or the like in such a way that the air inlet port 111 of the protective cap 30 is positioned at the center of the silencer 100. Thereby, a space 130 is defined between the silencer 100 and the inner surface of the protective cap 30.

The space 130 has a spherical shape, due to the protective cap 30 which has a curved shape. When air flows from the airline 20 through the air inlet port 111 into the protective cap 30, the air collides with the inner surface of the curved space 130, so that the air flows smoothly and noise is minimized.

Preferably, soundproof sponge 144 is also provided in the space 130. The soundproof sponge 144 is formed to correspond to the interior of the space 130, thus being attached to the lower surface of the upper portion and the upper surface of the lower portion of the silencer 100. Alternatively, the soundproof sponge 144 may be evenly inserted into the entire portion of the space 130.

The soundproof sponge 144 serves to further reduce the flow rate of the air entering the space 130, in addition to reducing noise generated by the flow of air.

Further, a plurality of air outlet holes 121 is formed on the lower portion of the silencer 100 to communicate with the space 130. Preferably, the air outlet holes 121 are formed along the circumference of the lower portion of the silencer 100 at regular intervals, and are formed to be continued along the upper curved surface of the silencer 100.

The air outlet holes 121 are vertically formed through the lower portion of the silencer 100. When the air fed from the airline 20 flows through the air inlet ports 111 into the space 130, the air is discharged through the air outlet holes 121 communicating with the space 130. Thereby, the air is supplied to a worker who wears the protective hood 10.

Preferably, the air outlet holes 121 are formed on the outer circumference of the silencer 100 at angular intervals from 30 degrees to 45 degrees.

Such a construction allows the air fed into the space 130 to collide with the inner wall of the space 130, thus reducing the flow rate of the air. Thereafter, the air is evenly discharged through the air outlet holes 121 which are continuously formed along the curved surface of the space 130. Therefore, a worker can respire fresh air under low-noise conditions.

The operational effects of this invention constructed as described above will be described below.

First, the airline 20 provided outside the protective hood 10 is coupled to the air inlet port 111 formed on the upper portion of the protective cap 30. Next, when the compressor coupled to the exterior airline 20 is operated, air flows along the airline 20 into the air inlet port 111.

The air fed into the air inlet port 111 moves into the space 130 comprising a smoothly curved surface. While the air collides with the curved surface of the space 130, the flow rate of the air is reduced. That is, the high-speed air fed through the air inlet port 111 collides with the inner wall of the space 130, so that the flow rate of the air is reduced.

The air having the reduced flow rate moves along the inner wall of the space 130, while being discharged through the air outlet holes 121 communicating with the space 130.

The soundproof sponge 144 provided inside the space 130 further reduces the flow rate of the air colliding with the inner wall of the space 130, and absorbs noise generated by the collision of the air, thus further reducing the noise.

As described above, the present invention provides a silencer for an airline hood and a protective hood having the silencer which is worn by a worker who performs various work, including painting work, shortening work, and sanding work, at industrial sites, thus reducing noise due to the supply of air, therefore allowing the worker to concentrate on the work. Further, this invention is capable of protecting the worker's body, thus being widely usable at many industrial sites.

What is claimed is:

1. A silencer for an airline hood, comprising:

an upper unit open at a lower portion thereof and formed to be upwardly convex, with an air inlet port being provided at a predetermined position on the upper unit and being coupled to an airline;

a lower unit hermetically coupled to the lower portion of the upper unit, thus defining a space, with a plurality of air outlet holes each formed in a generally vertical or oblique direction through the lower unit; and air distributing means provided on the lower portion of the upper unit and an upper portion of the lower unit, and distributing air fed from the airline in the space prior to discharging the air through the air outlet holes.

2. The silencer according to claim 1, wherein the upper unit has a circular shape.

3. The silencer according to claim 1, wherein the lower unit is coupled to an outer end of the upper unit, the air outlet holes being formed on the lower unit in such a way as to be continued along a curved surface of the upper unit from an inner end of the upper unit to the outer end thereof.

4. The silencer according to claim 3, wherein the air outlet holes are formed along a circumference of the lower unit, and are formed on an outer portion of the lower unit at angular intervals from 30 degrees to 45 degrees.

5. The silencer according to claim 1, wherein the air distributing means comprises:

a first distributing ring provided on the lower unit, and formed to be concentric with the air inlet port, the first distributing ring primarily colliding with the air fed from the airline, thus reducing a flow rate of the air;

a second distributing ring provided on the upper unit, and formed to be concentric with the first distributing ring, the second distributing ring colliding with the air which has collided with the first distributing ring and has the reduced flow rate, thus secondarily reducing the flow rate of the air; and a third distributing ring provided on the lower unit, and formed to be concentric with the second distributing ring, the third distributing ring colliding with the air which has been reduced in flow rate by the second distributing ring, thus further reducing the flow rate of the air.

6. The silencer according to claim 5, wherein the air distributing means further comprises:

soundproof sponge provided inside the first distributing ring, between the first and second distributing rings, between the second and third distributing rings, and outside the third distributing ring.

7. A protective hood comprising:

a protective cap having an airline coupled thereto;

a silencer installed in the protective cap to reduce noise caused by air supplied from the airline, wherein the silencer comprises:

an upper unit open at a lower portion thereof and formed to be upwardly convex, with an air inlet port being provided at a predetermined position on the upper unit and being coupled to the airline;

a lower unit hermetically coupled to the lower portion of the upper unit, thus defining a space, with a plurality of air outlet holes each formed in a generally vertical or oblique direction through the lower unit; and air distributing means provided on the lower portion of the upper unit and an upper portion of the lower unit, and distributing air fed from the airline in the space prior to discharging the air through the air outlet holes.

8. The protective hood according to claim 7, wherein the upper unit has a circular shape.

9. The protective hood according to claim 7, wherein the lower unit is coupled to an outer end of the upper unit, the air outlet holes being formed on the lower unit in such a way as to be continued along a curved surface of the upper unit from an inner end of the upper unit to the outer end thereof.

10. The protective hood according to claim 9, wherein the air outlet holes are formed along a circumference of the lower unit, and are formed on an outer portion of the lower unit at angular intervals from 30 degrees to 45 degrees.

11. The protective hood according to claim 7, wherein the air distributing means comprises:

a first distributing ring provided on the lower unit, and formed to be concentric with the air inlet port, the first distributing ring primarily colliding with the air fed from the airline, thus reducing a flow rate of the air;

a second distributing ring provided on the upper unit, and formed to be concentric with the first distributing ring, the second distributing ring colliding with the air which has collided with the first distributing ring and has the reduced flow rate, thus secondarily reducing the flow rate of the air; and a third distributing ring provided on the lower unit, and formed to be concentric with the second distributing ring, the third distributing ring colliding with the air which has been reduced in flow rate by the second distributing ring, thus further reducing the flow rate of the air.

12. The protective hood according to claim 11, wherein the air distributing means further comprises:

soundproof sponge provided inside the first distributing ring, between the first and second distributing rings, between the second and third distributing rings, and outside the third distributing ring.

13. A protective hood comprising:

a protective cap having an upwardly concave inner surface, the protective cap including an air inlet port with an airline coupled to the air inlet port;

a silencer installed in the protective cap, the silencer having an upwardly convex outer surface with its circumference corresponding to the concave inner surface of the protective cap, the silencer hermetically attached to the protective cap such that the air inlet port of the protective cap is positioned at a center of the silencer, and defining a predetermined space between the convex outer surface of the silencer and the concave inner surface of the protective cap, with a plurality of air outlet holes each formed in a generally vertical or oblique direction through the silencer to communicate with the space.

14. The protective hood according to claim 13, wherein the air outlet holes are formed through the silencer at angular intervals from 30 degrees to 45 degrees.

15. The protective hood according to claim 13, further comprising:

soundproof sponge provided in the space.

* * * * *